US011480076B1

(12) United States Patent
Jeon et al.

(10) Patent No.: US 11,480,076 B1
(45) Date of Patent: Oct. 25, 2022

(54) COMPRESSION RELEASE TYPE ENGINE BRAKE

(71) Applicants: Hyundai Motor Company, Seoul (KR); Kia Corporation, Seoul (KR)

(72) Inventors: Jae Hee Jeon, Hwaseong-si (KR); Woong Na, Hwaseong-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/545,749

(22) Filed: Dec. 8, 2021

(30) Foreign Application Priority Data

May 4, 2021 (KR) ..... 10-2021-0057736

(51) Int. Cl.

| | |
|---|---|
| ***F01L 13/06*** | (2006.01) |
| ***F01L 1/24*** | (2006.01) |
| ***F01L 1/26*** | (2006.01) |
| ***F01L 1/46*** | (2006.01) |
| *F01L 1/18* | (2006.01) |

(52) U.S. Cl.
CPC ..... *F01L 13/06* (2013.01); *F01L 1/2411* (2013.01); *F01L 1/267* (2013.01); *F01L 1/46* (2013.01); *F01L 1/181* (2013.01)

(58) Field of Classification Search
CPC ..... F01L 1/181; F01L 1/2411; F01L 1/267; F01L 1/46; F01L 13/06
USPC ..... 123/90.39, 90.4, 90.44, 90.46
See application file for complete search history.

(56) References Cited

U.S. PATENT DOCUMENTS

| | | | | | |
|---|---|---|---|---|---|
| 2,908,262 | A * | 10/1959 | Gropp | F01L 1/181 | 123/90.39 |
| 3,150,648 | A * | 9/1964 | Gropp | F01L 1/181 | 74/559 |
| 5,303,467 | A * | 4/1994 | Narita | F01L 1/181 | 29/888.01 |
| 5,553,583 | A * | 9/1996 | Jones | F01M 9/10 | 123/90.34 |
| 2004/0129240 | A1* | 7/2004 | Hughes | F01L 1/181 | 123/90.27 |
| 2010/0307451 | A1* | 12/2010 | Lee | F02D 13/04 | 123/321 |
| 2013/0239916 | A1* | 9/2013 | Strusch | F01M 9/10 | 123/90.1 |

* cited by examiner

*Primary Examiner* — Jorge L Leon, Jr.
(74) *Attorney, Agent, or Firm* — Morgan, Lewis & Bockius LLP

(57) ABSTRACT

A compression release type engine brake includes a first opening unit and a second opening unit each including an exhaust rocker arm, an adjusting screw provided at an end portion of the exhaust rocker arm, a brake module in which brake oil is selectively and a brake piston mount portion is formed therein, a brake piston which is selectively protruded according to the oil supply inside the brake module, a reset member selectively exhausting the oil in the brake module, and a valve bridge connected to the brake piston and provided with an exhaust valve, and wherein a rocker arm protrusion is formed in the exhaust rocker arm of at least one of the first opening unit and the second opening unit, and the shaft spring presses the rocker arm protrusion and adjusts a distance between the first opening unit and the second opening unit.

15 Claims, 14 Drawing Sheets

COMPRESSION RELEASE TYPE ENGINE BRAKE

CROSS-REFERENCE TO RELATED APPLICATION

The present application claims priority to Korean Patent Application No. 10-2021-0057736 filed on May 4, 2021, the entire contents of which is incorporated herein for all purposes by this reference.

BACKGROUND OF THE INVENTION

Field of the Invention

The present invention relates to a compression release type engine brake. More particularly, the present invention relates to a compression release type engine brake including a shaft spring supporting an exhaust rocker arm.

Description of Related Art

In general, the brake system of an internal combustion engine vehicle generally utilizes a hydraulic pressure brake, but the engine brake is used to prevent premature wear of the brake pad during downhill driving or frequent sudden stops.

A compression release type engine brake, a type of engine brake, temporarily opens the exhaust valve at the end portion of the compress stroke, that is, near the top dead center of the compress stroke of the piston, among the four basic strokes of the engine to exhaust the compressed air in the cylinder out of the cylinder. Accordingly, it induces a pumping loss in the expansion stroke to obtain a braking effect.

In a typical compression release type engine brake, a brake module is applied between a valve bridge connected to a pair of exhaust valve and an exhaust rocker arm.

The brake module includes a brake piston inside the housing through which brake oil inflows. During engine brake operation, the brake piston moves downward to remove the gap between the exhaust rocker arm and the exhaust cam, forcibly opening the exhaust valve at the end of the compress stroke.

By the present brake module, the exhaust valve is opened at the end of the compress stroke to add braking force to the vehicle, but once the engine brake oil inflows into the brake module, it is not exhausted. There is a problem that the valve opens more.

FIG. 13 is a graph showing the valve lift displacement when a general compression release type engine brake is used.

That is, as shown in FIG. 13, there is a possibility that contact (A) between the exhaust valve and the engine piston may occur during operation of the compression release type engine brake.

On the other hand, to improve this, a compression release type engine brake provided with a reset bracket on one side of the brake module is provided, but since the reset bracket needs to be applied separately to the outside of the reset module, the overall size is increased.

Also, for the normal operation of a general compression release type engine brake, the contact characteristic between the screw and the brake module is important.

FIG. 14 is a graph showing the valve lift during operation of a general compression release type engine brake.

As shown in FIG. 14, if the contact characteristic between the screw and the brake module is weakened, there may be a gap between the screw and the brake module, which may result in poor operation of the engine brake.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an engine brake apparatus with a shaft spring supporting an exhaust rocker arm to enhance the contact characteristic between the screw and the brake module.

Furthermore, various aspects of the present invention are directed to providing an engine brake apparatus in which a shaft spring supporting the exhaust rocker arm pushes the exhaust rocker arm in the axial direction, eliminating the need for a rocker arm spacer.

An engine brake apparatus according to various exemplary embodiments of the present invention may include a first opening unit and a second opening unit each including an exhaust rocker arm that rotates around a rocker arm shaft, an adjusting screw provided at a first end portion of the exhaust rocker arm, a brake module in which oil is selectively inflowed from the adjusting screw and a brake piston mount portion is formed therein, a brake piston which is movably provided on the brake piston mount portion, wherein a portion of the brake piston is selectively protruded out of the brake module according to the oil supply inside the brake module, a reset member selectively exhausting the oil in the brake module, and a valve bridge connected to the brake piston and provided with an exhaust valve, and a shaft spring mounted between the first opening unit and the second opening unit, and wherein a rocker arm protrusion is formed in the exhaust rocker arm of at least one of the first opening unit and the second opening unit, and the shaft spring presses the rocker arm protrusion and adjusts a distance between the first opening unit and the second opening unit.

The shaft spring may include a coil portion wound around the rocker arm shaft, and an extension formed extending from the coil portion and pressing the rocker arm protrusion.

A shaft fixing hole may be formed in the rocker arm shaft, and the shaft spring may further include a fixing portion inserted into the shaft fixing hole.

Each of the first opening unit and the second opening unit may further include an intake rocker arm that rotates around the rocker arm shaft, and wherein the shaft spring may be provided between the exhaust rocker arm of the first opening unit and the intake rocker arm of the second opening unit.

The intake rocker arm may further include an intake rocker arm protrusion formed to protrude outward therefrom, and wherein the shaft spring may further include a fixing portion fixed to the intake rocker arm protrusion.

The brake module may include an inlet formed on an upper portion thereof to allow oil to flow in from the adjusting screw, and a reset member mount portion formed on a side thereof to fluidically communicate with the brake piston mount portion.

The engine brake apparatus may further include a push pin mounted to an upper portion of a cylinder head, and wherein the reset member may selectively contact with the push pin to selectively discharge oil in the brake module.

The reset member mount portion may include a first passage fluidically connected to the brake piston mount portion through a first outlet, and a second passage connected to the first passage through a slanted surface having a smaller diameter than a diameter of the first passage, and connected to a second outlet of the reset member mount portion that exhausts the oil.

The reset member may include a reset valve movably provided in the reset member mount portion to open or close the second outlet, and a reset spring elastically biasing the reset valve in a predetermined direction.

A passage groove may be formed inwardly on the upper external circumference of the reset valve, and the upper portion of the reset valve may be caught on the slanted surface and supported so as not to be separated downward.

The brake piston may be inserted into the brake piston mount portion, and an accommodation space may be formed thereon.

The engine brake apparatus according to various exemplary embodiments of the present invention may further include a check valve disposed in the accommodation space, elastically supported by a check valve spring to open or close the inlet.

The engine brake apparatus according to various exemplary embodiments of the present invention may further include a stopper disposed on the brake module to limit a movement position of the brake piston.

The brake piston may further include an upper protrusion and a lower protrusion protruding from an outer circumference of the brake piston to restrict movement by the stopper.

According to the engine brake apparatus of the exemplary embodiment of the present invention, it is possible to strengthen the contact characteristic between the screw and the brake module by providing a shaft spring supporting the exhaust rocker arm.

Furthermore, in the exemplary embodiment of the present invention, the shaft spring supporting the exhaust rocker arm pushes the exhaust rocker arm in the axial direction, eliminating the demand for a rocker arm spacer.

Furthermore, the effects obtainable or predicted by the exemplary embodiments of the present invention are to be included directly or implicitly in the detailed description of the exemplary embodiments of the present invention. That is, various effects predicted according to various exemplary embodiments of the present invention will be included in the detailed description to be described later.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
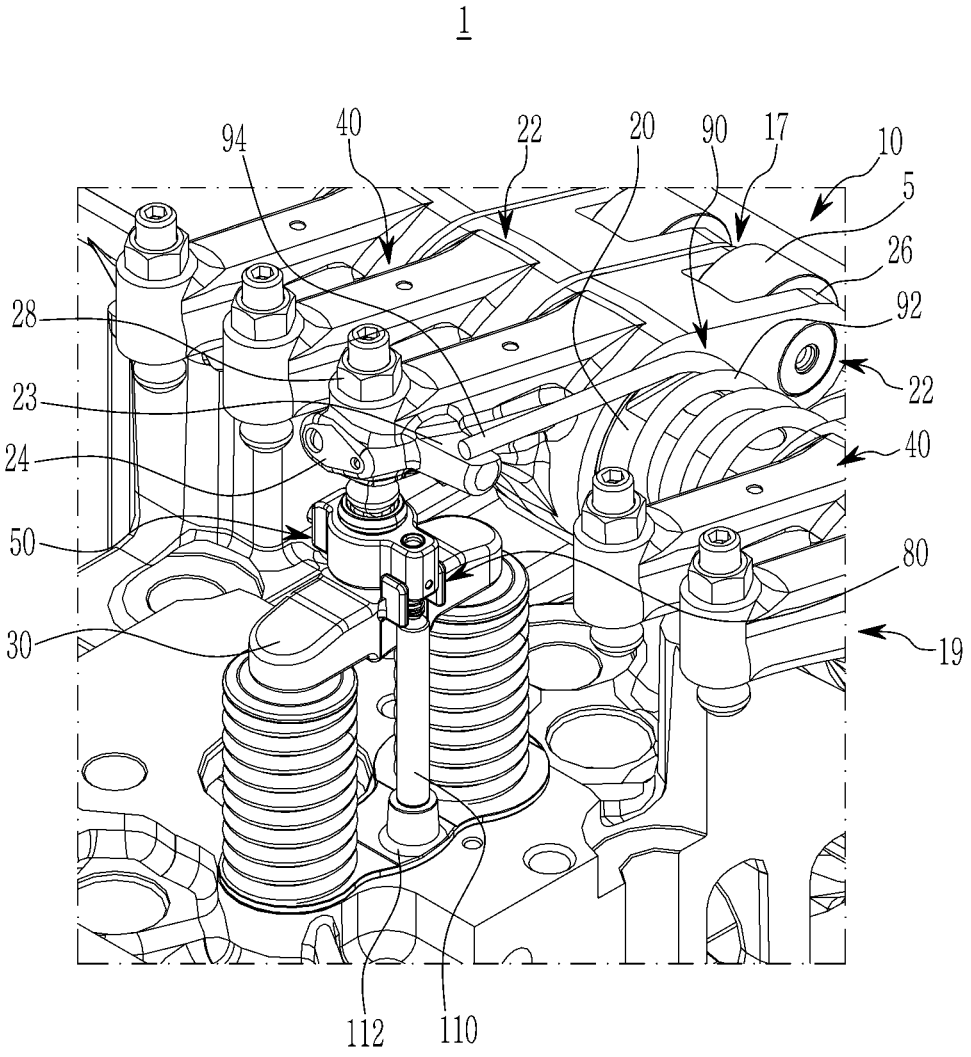
FIG. 1 is a perspective view of a compression release type engine brake according to various exemplary embodiments of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Exemplary embodiments of the present application will be described more fully hereinafter with reference to the accompanying drawings, in which exemplary embodiments of the present invention are shown. As those skilled in the art would realize, the described embodiments may be modified in various different ways, all without departing from the spirit or scope of the present invention.

To clearly explain various exemplary embodiments of the present invention, parts irrelevant to the description are omitted, and the same reference numerals are assigned to the same or similar elements throughout the specification.

Since the size and thickness of each component shown in the drawings are arbitrarily indicated for convenience of description, the present invention is not necessarily limited to that shown in the drawings, and the thickness is enlarged to clearly express various parts and regions.

Furthermore, in the following detailed description, the names of the components include first, second, etc., to classify the components in the same relationship, and the order is not necessarily limited in the following description.

Throughout the specification, when a part includes a certain component, it means that other components may be further included, rather than excluding other components, unless otherwise stated.

Furthermore, terms such as . . . part, . . . means described in the specification mean a unit of a comprehensive configuration that performs at least one function or operation.

When a part, such as a layer, film, region, plate, etc., is "on" another part, it includes not only the case where it is directly above the other part, but further the case where there is another part in between.

In contrast, when an element is referred to as being "directly on" another element, there are no intervening elements present.

Various exemplary embodiments of the present invention will hereinafter be described in detail with reference to the accompanying drawings.

Figure 2:
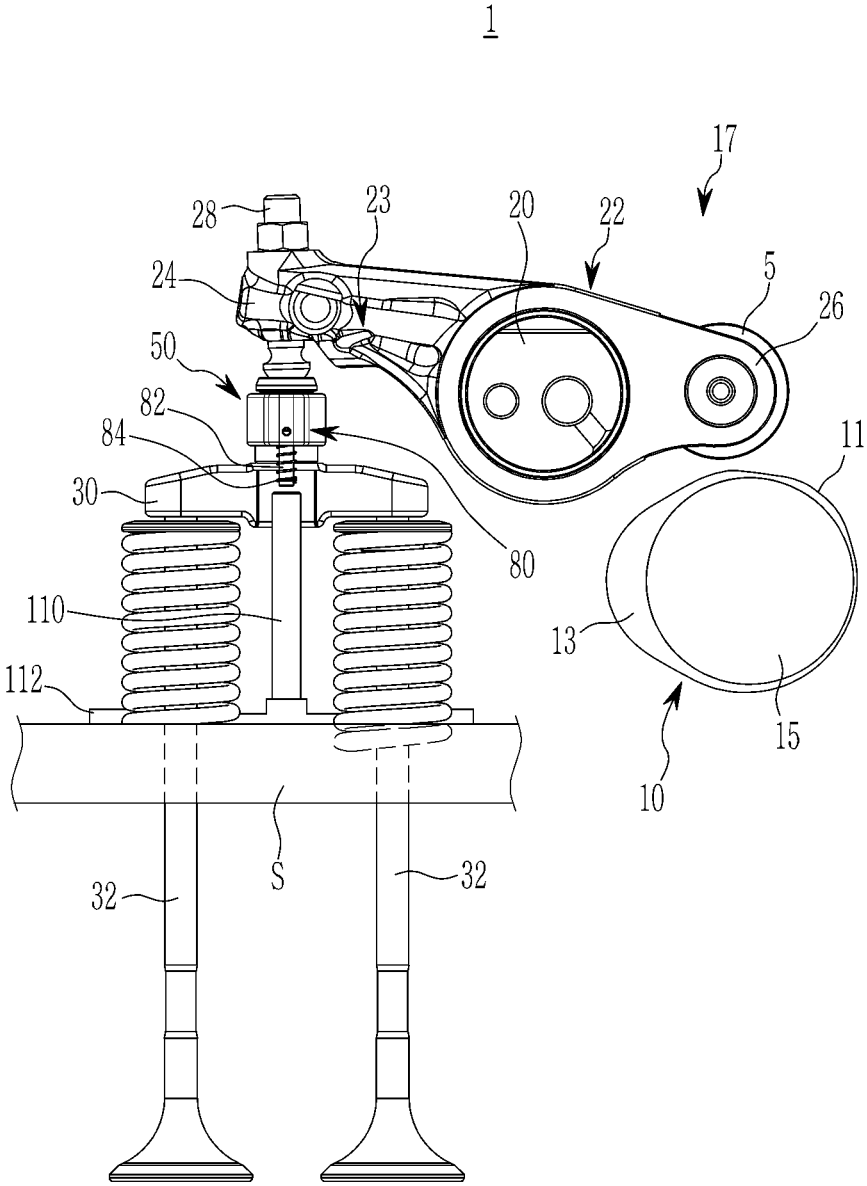
FIG. 2 is a front view of a compression release type engine brake according to various exemplary embodiments of the present invention.

FIG. 1 is a perspective view of a compression release type engine brake according to various exemplary embodiments of the present invention, and FIG. 2 is a front view of a compression release type engine brake according to various exemplary embodiments of the present invention.

Figure 3:
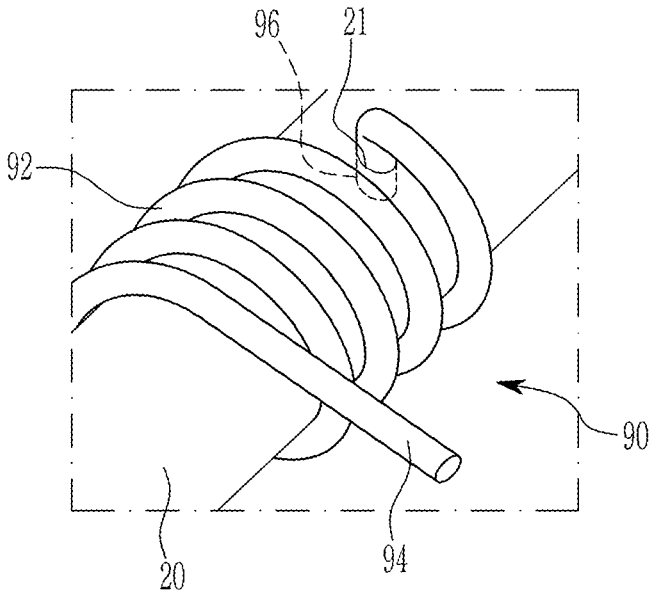
FIG. 3 is a drawing showing a shaft spring which may be applied to a compression release type engine brake according to various exemplary embodiments of the present invention.

FIG. 3 is a drawing showing a shaft spring which may be applied to a compression release type engine brake according to various exemplary embodiments of the present invention.

Referring to FIG. 1 to FIG. 3, a compression release type engine brake 1 according to various exemplary embodiments of the present invention may include an exhaust rocker arm 22 rotating around a rocker arm shaft 20, an adjusting screw 28 provided at a first end portion 24 of the exhaust rocker arm 22, a brake module 50, a reset member 80 selectively exhausting oil in the brake module 50, and a first opening unit 17 and a second opening unit 19 each including a valve bridge 30 to which an exhaust valve 32 is mounted. Furthermore, the compression release type engine brake 1 according to various exemplary embodiments of the present invention may include a shaft spring 90 mounted between the first opening unit 17 and the second opening unit 19. A rocker arm protrusion 23 may be formed in the exhaust rocker arm 22 of at least one of the first opening unit 17 and the second opening unit 19 and the shaft spring 90 presses the rocker arm protrusion 23 and may adjust the distance between the first opening unit 17 and the second opening unit 19.

A roller 5 is mounted on a second end portion 26 of the exhaust rocker arm 22, and is configured to contact or not contact with an exhaust cam 10 mounted on a camshaft 15.

If the exhaust cam 10 is divided by profile, it may be divided into a brake cam lobe section and a main cam lobe section. The brake cam lobe section and the main cam lobe section are formed by the brake cam lobe 11 and the main cam lobe 13 on the camshaft 15.

The main cam lobe 13 contacts with the roller 5 to realize the exhaust stroke, and the brake cam lobe 11 contacts with the roller 5 to open the exhaust valve 32 during engine brake operation.

Before engine brake operation (during the basic engine stroke), the roller 5 is always separated from the brake cam lobe 11 of the exhaust cam 10 by the shaft spring 90, and the roller 5 is pushed up only by the main cam lobe 13 of the exhaust cam 10 during the exhaust stroke.

That is, if the operation oil for operating the engine brake is not supplied, there is a gap between the roller 5 provided on the second end portion 26 of the exhaust rocker arm 22 and the exhaust cam 10, so that the engine brake does not work because brake cam lobe 11 of the exhaust cam 10 and roller 5 do not contact.

On the other hand, when operation oil is supplied to operate the engine brake, the brake module 50 lifts the first end portion 24 of the exhaust rocker arm 22 so that the roller 5 and exhaust cam 10 are always in contact and at the end portion of the compress stroke, the exhaust rocker arm 22 operates by the brake cam lobe 11 of the exhaust cam 10, so that a braking effect may be obtained.

In FIG. 1, only a part of the second opening unit 19 is shown for convenience of understanding, but the second opening unit 19 may include the same configuration as the first opening unit 17.

The shaft spring 90 may include a coil portion 92 wound around the rocker arm shaft 20, and an extension 94 formed extending from the coil portion 92 to press the rocker arm protrusion 23.

A shaft fixing hole 21 is formed in the rocker arm shaft 20, and the shaft spring 90 may further include a fixing portion 96 inserted into the shaft fixing hole 21.

That is, one end portion of the shaft spring 90 is fixed to the shaft fixing hole 21, and the other end portion presses the rocker arm protrusion 23 to keep the distance between the adjusting screw 28 and the brake module 50 constant.

Each of the first opening unit 17 and the second opening unit 19 may further include an intake rocker arm 40 that rotates about the rocker arm shaft 20.

The shaft spring 90 may be provided between the exhaust rocker arm 22 of the first opening unit 17 and the intake rocker arm 40 of the second opening unit 19.

Figure 4:
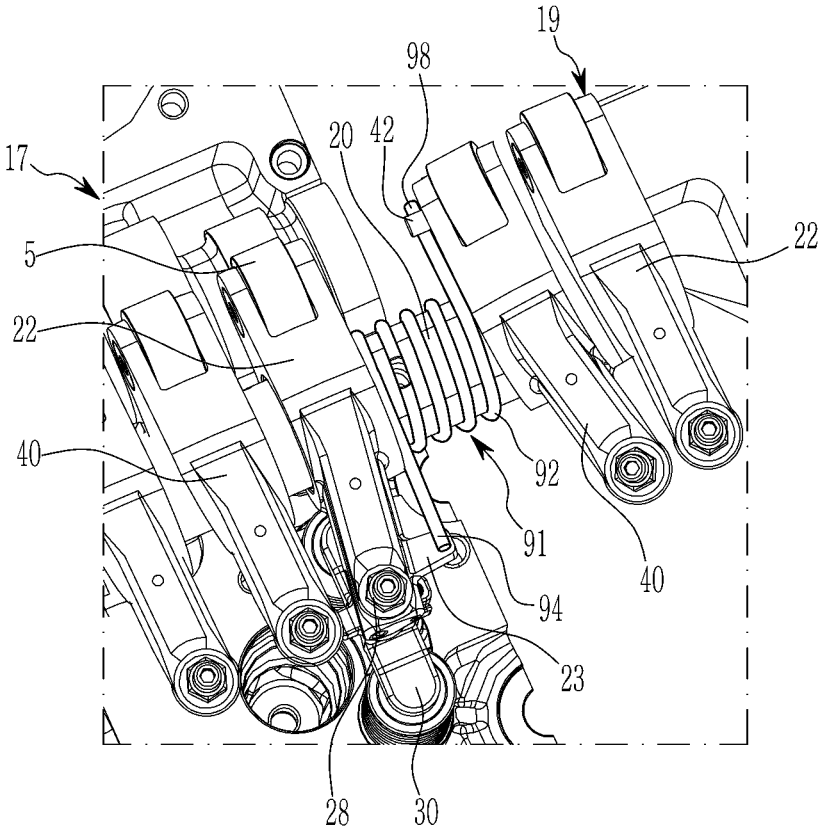
FIG. 4 is a perspective view of a compression release type engine brake according to a modified exemplary embodiment of the present invention.

FIG. 4 is a perspective view of a compression release type engine brake according to a modified exemplary embodiment of the present invention.

Referring to FIG. 4, since the compression release type engine brake according to a modified exemplary embodiment of the present invention is the same as the configuration of the compression release type engine brake according to various exemplary embodiments of the present invention described above, except for the connection configuration of the shaft spring, for the same configuration, the same reference numerals are used, and repeated descriptions are omitted.

The intake rocker arm 40 of the compression release type engine brake according to a modified exemplary embodiment of the present invention further includes an intake rocker arm protrusion 42 protrudingly formed outside thereof, and the shaft spring 91 may further include a fixing portion 98 fixed to the intake rocker arm protrusion 42.

One end portion of the shaft spring 90 of the compression release type engine brake according to various exemplary embodiments of the present invention shown in FIG. 1 to FIG. 3 is fixed to the shaft fixing hole 21, and the other may press the rocker arm protrusion 23 to keep the distance between the adjusting screw 28 and the brake module 50 constant.

One end portion of the shaft spring 91 of the compression release type engine brake according to the modified exemplary embodiment of the present invention shown in FIG. 4 is fixed to the intake rocker arm protrusion 42, and the other end portion may press the rocker arm protrusion 23 to keep the distance between the adjusting screw 28 and the brake module 50 constant.

In exemplary embodiments of the present invention, it may be easy to adjust the contact characteristic required between the adjusting screw 28 and the brake module 50 by adjusting the number of coil windings of the shaft spring 90, and 91.

Furthermore, the shaft springs 90, and 91 replace the role of the rocker arm spacer by use of the spring load, and robustness may be secured against the load in the axial direction of the rocker arm shaft 20. That is, the gap between the first opening unit 17 and the second opening unit 19 may be kept constant by the axial direction pushing force of the shaft spring 90, and 91.

Furthermore, the shaft spring 90, and 91 have a simple coupling structure, and parts for fixing the spring may be eliminated.

Figure 5:
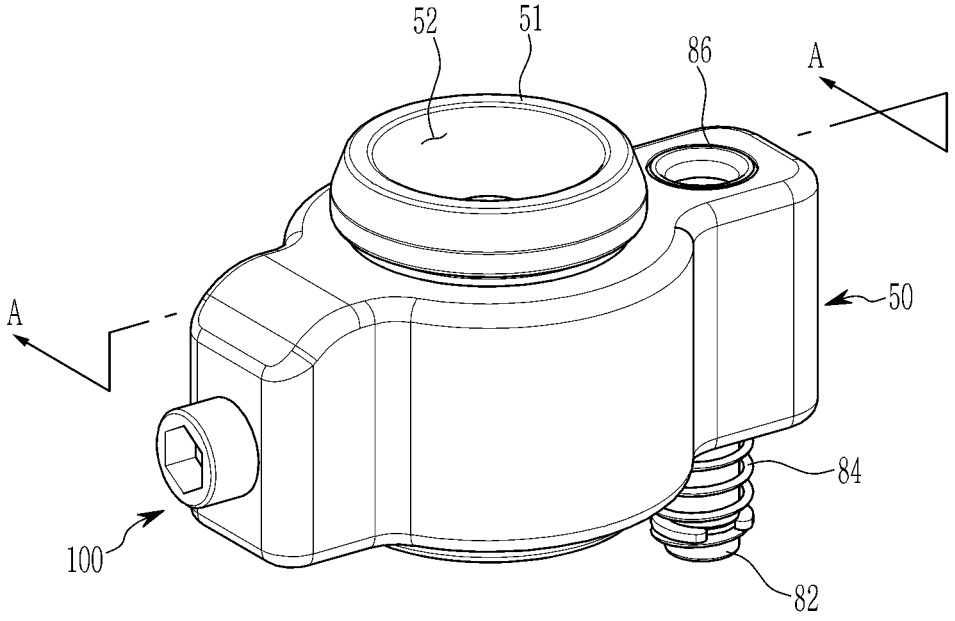
FIG. 5 is a perspective view of a brake module which may be applied to a compression release type engine brake according to various exemplary embodiments of the present invention.
Figure 6:
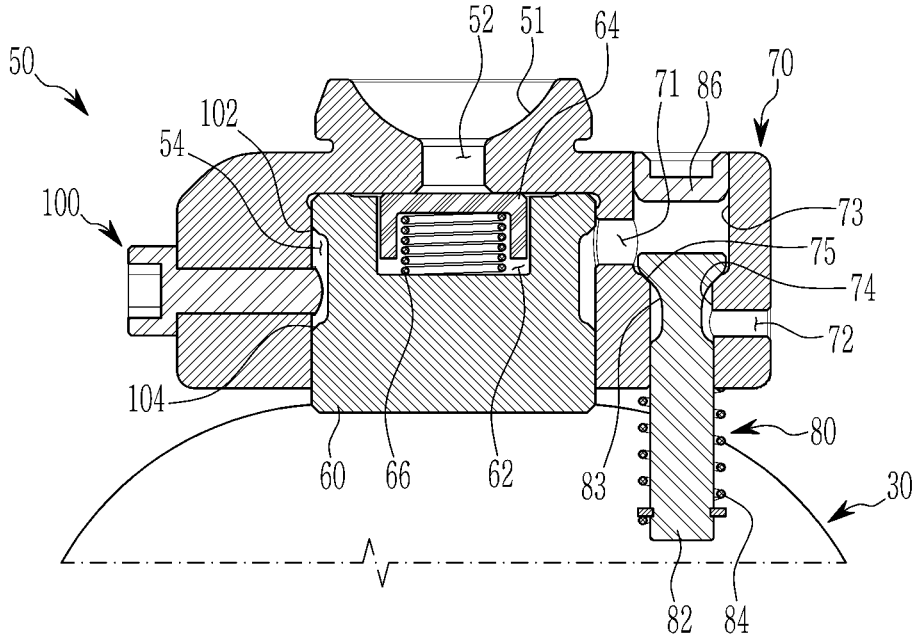
FIG. 6, FIG. 7 and FIG. 8 is a cross-sectional view along line A-A of FIG. 5 illustrating an operation of a compression release type engine brake according to various exemplary embodiments of the present invention.
Figure 7:
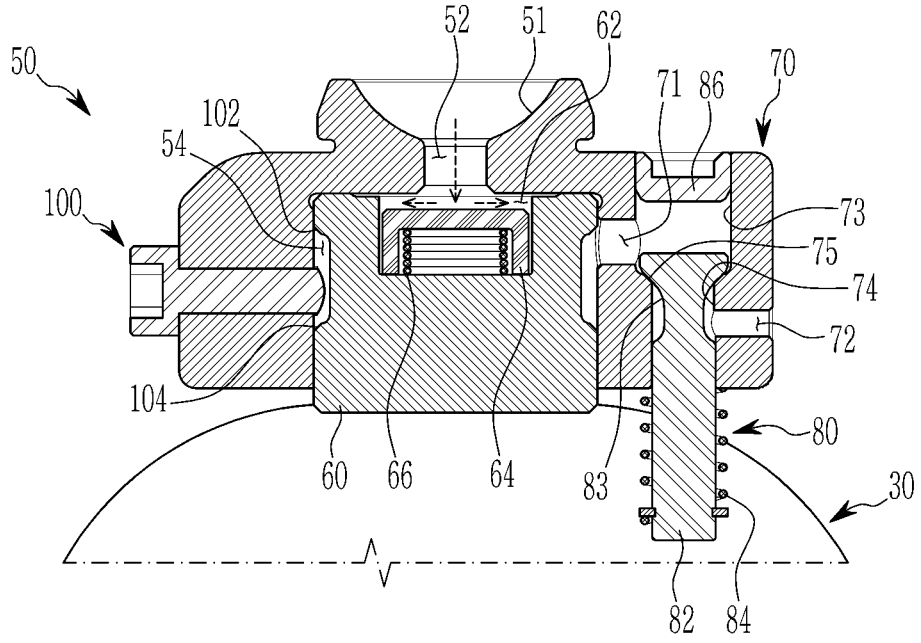
Figure 8:
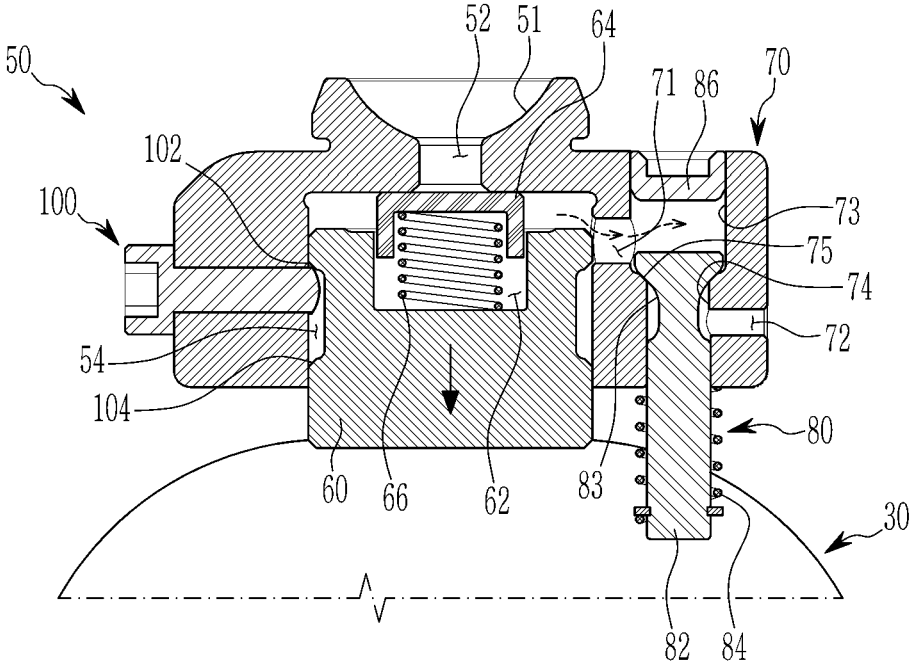

FIG. 5 is a perspective view of a brake module which may be applied to a compression release type engine brake according to various exemplary embodiments of the present invention, and FIG. 6, FIG. 7 and FIG. 8 is a cross-sectional view along line A-A of FIG. 5 illustrating an operation of a compression release type engine brake according to various exemplary embodiments of the present invention.

Since the compression release type engine brake according to various exemplary embodiments of the present invention and the compression release type engine brake according to the modified exemplary embodiment of the present invention are the same except for the connection configuration of the shaft spring, for convenience of understanding, it will be referred to as a compression release type engine brake according to various exemplary embodiments of the present invention.

In the brake module 50, brake oil is selectively inflowed from the adjusting screw 28, and a brake piston mount portion 54 is formed inside therein.

A brake piston 60 is movably provided on the brake piston mount portion 54 and brake piston 60 may be selectively protruded according to the oil supply inside the brake module 50.

The valve bridge 30 is connected to the brake piston 60 and when the brake piston 60 protrudes, the exhaust valve 32 opens.

The brake module 50 may include an inlet 52 formed on an upper portion thereof to allow brake oil to flow in from the adjusting screw 28 and a reset member mount portion 70 formed on a side thereof to fluidically communicate with the brake piston mount portion 54.

Referring to FIG. 1, FIG. 2 and FIG. 5, a seating portion 51 is formed on the upper portion the brake module 50, and the adjusting screw 28 is accommodated on the seating portion 51.

The compression release type engine brake 1 according to various exemplary embodiments of the present invention further includes a push pin 110 mounted to an upper portion of the cylinder head S, and the reset member 80 may selectively exhaust the oil in the brake module 50 by selectively contacting with the push pin 110. The push pin 110 may be mounted to the cylinder head S though a push pin bracket 112.

The reset member mount portion 70 may include a first passage 73 connected to the brake piston mount portion 54 through a first outlet 71, and a second passage 74 connected to the first passage 73 through a slanted surface 75, having a diameter smaller than a diameter of the first passage 73, and connected to a second outlet 72 exhausting brake oil.

The reset member 80 may include a reset valve 82 movably provided in the reset member mount portion 70 to open or close the second outlet 72, and a reset spring 84 elastically supporting the reset valve 82.

The reset valve 82 is formed with a passage groove 83 recessed inward on the circumference of its upper external circumference, and its upper portion is caught on the slanted surface 75 and may be supported so as not to be separated downward.

After processing the reset member mount portion 70, it may be blocked by mounting a reset valve cap 86 on the upper portion of the first passage 73.

The brake piston 60 may be inserted into the brake piston mount portion 54, and an accommodation space 62 may be formed thereon.

The compression release type engine brake 1 according to various exemplary embodiments of the present invention may further include a check valve 64 disposed in the accommodation space 62, elastically supported by a check valve spring 66 to open or close the inlet 52.

The compression release type engine brake 1 according to various exemplary embodiments of the present invention may further include a stopper 100 disposed on the brake module 50 to limit a movement position of the brake piston 60.

The brake piston 60 may further include an upper protrusion 102 and a lower protrusion 104 formed on the brake piston 60 to restrict movement by the stopper 100.

Figure 9:
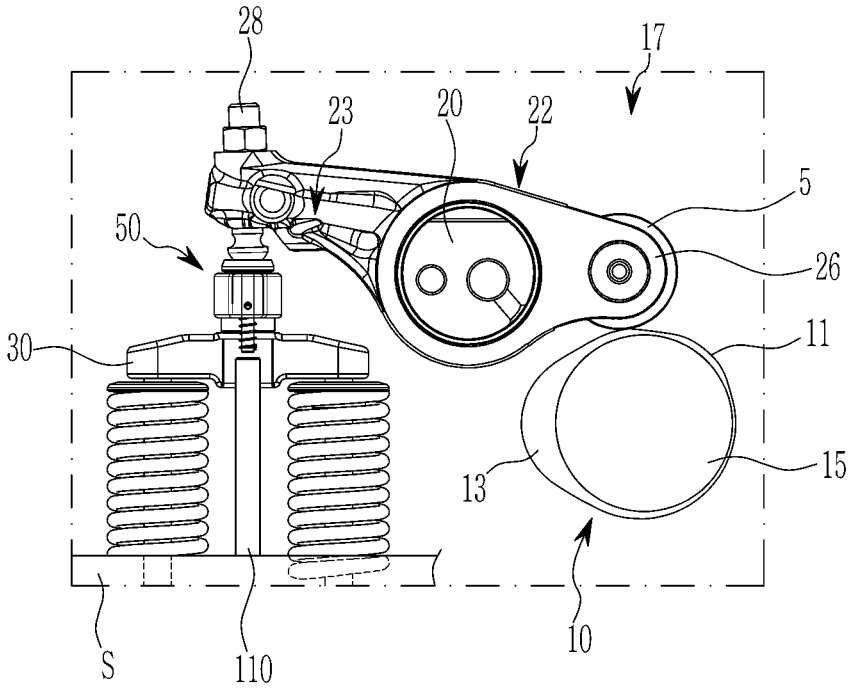
FIG. 9 is a front view showing the operation of a compression release type engine brake according to various exemplary embodiments of the present invention.
Figure 10:
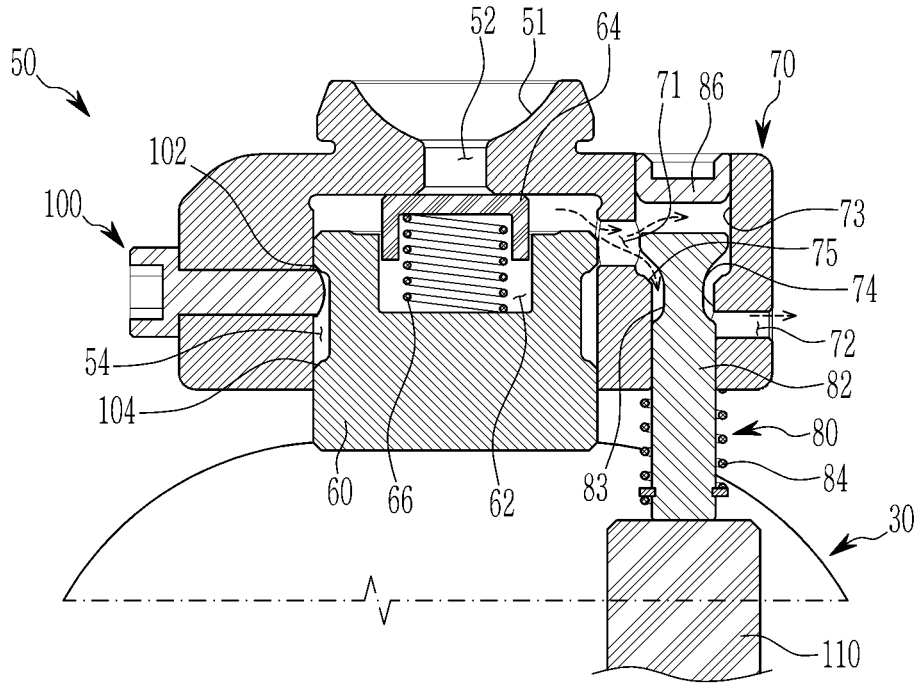
FIG. 10 and FIG. 11 is a cross-sectional view along line A-A of FIG. 5 showing pressure relief of a compression release type engine brake according to various exemplary embodiments of the present invention.
Figure 11:
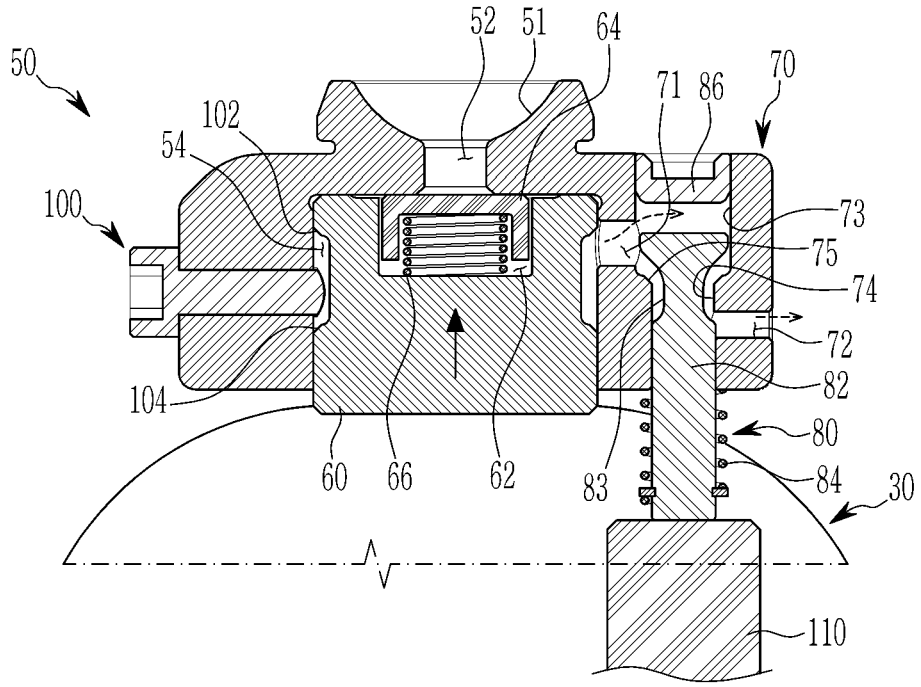

FIG. 9 is a front view showing the operation of a compression release type engine brake according to various exemplary embodiments of the present invention, and FIG. 10 and FIG. 11 is a cross-sectional view along line A-A of FIG. 5 showing pressure relief of a compression release type engine brake according to various exemplary embodiments of the present invention.

Hereinafter, referring to FIG. 1 to FIG. 11, the operation of the compression release type engine brake according to various exemplary embodiments of the present invention will be described.

As shown in FIG. 6, when the engine brake is not operating, operation oil is not supplied through the adjusting screw 28, so that the brake piston 60 is positioned inside the brake piston mount portion 54. That is, the brake piston 60 is not protrude from the brake piston mount portion 54. As shown in FIG. 2, because there is a gap between the roller 5 and the exhaust cam 10, brake cam lobe 11 of the exhaust cam 10 and roller 5 do not contact, so that the engine brake does not operate.

At the present time, the reset valve 82 blocks the first passage 73 by the elastic force of the reset spring 84. That is, the passage groove 83 is in close contact with the slanted surface 75, so that the first passage 73 and the second passage 74 are not connected to each other.

As shown in FIG. 7 and FIG. 8, when the engine brake operates, operation oil is supplied from an oil supply portion and the operation oil is supplied to the inlet 52 communicating with the adjusting screw 28. Accordingly, the check valve 64 moves downward by the pressure of the operation oil, and the operation oil is supplied to the brake piston mount portion 54 inside the brake module 50.

Accordingly, the brake piston 60 descends by the operation oil, the check valve 64 closes the inlet 52 by the restoring force of the check valve spring 66, and the brake piston mount portion 54 is closed.

That is, the brake piston 60 descends by the operation oil, the relative length of the brake module 50 increases, and the exhaust rocker arm 22 rotates relative with respect to the rocker arm shaft 20 (clockwise in FIG. 2).

At the present time, the upper protrusion 102 and the stopper 100 may contact to limit the protrusion amount of the brake piston 60.

Accordingly, as shown in FIG. 9, the roller 5 provided to the exhaust rocker arm 22 and the exhaust cam 10 contact.

Accordingly, the main cam lobe 13 contacts with the roller 5 to realize the exhaust stroke, and the brake cam lobe 11 temporarily opens the exhaust valve 32 at the end portion of the compress stroke, that is, near the compress top dead center portion of the piston. The present induces a pumping loss of the expansion stroke and a braking effect may be obtained.

Referring to FIG. 10 and FIG. 11, the push pin 110 contacts with the reset valve 82 and pushes the reset valve 82, and the reset valve 82 moves relatively upwards.

Accordingly, the passage groove 83 is separated from the slanted surface 75, and the first passage 73 and the second passage 74 fluidically communicate with and then the operation oil of the brake piston mount portion 54 is exhausted through the first outlet 72, the first passage 73, the second passage 74 and the second outlet 72. Accordingly, the brake piston 60 is positioned inside the brake piston mount portion 54.

Figure 12:
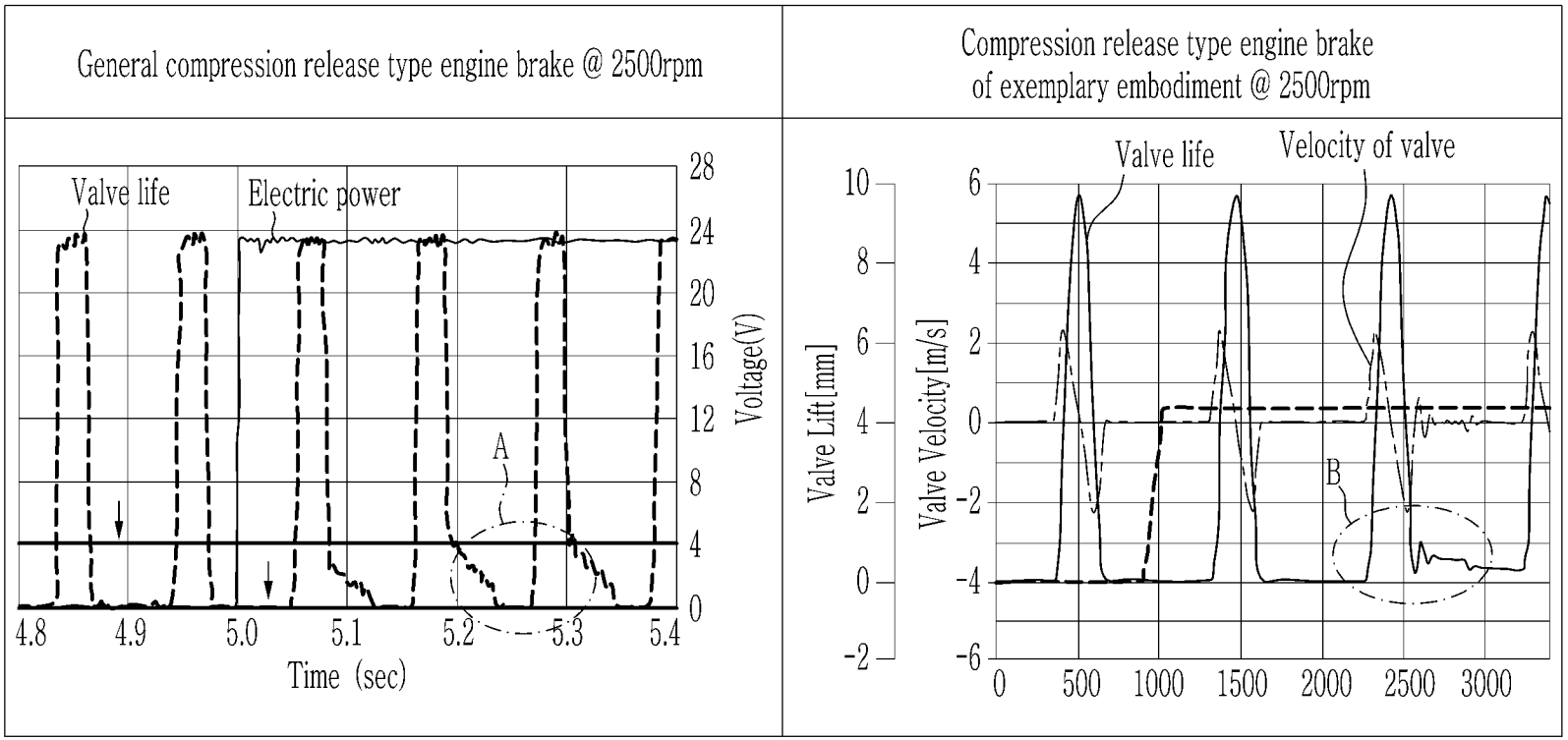
FIG. 12 is a graph comparing the operation of a general compression release type engine brake and a compression release type engine brake according to various exemplary embodiments of the present invention.
Figure 13:
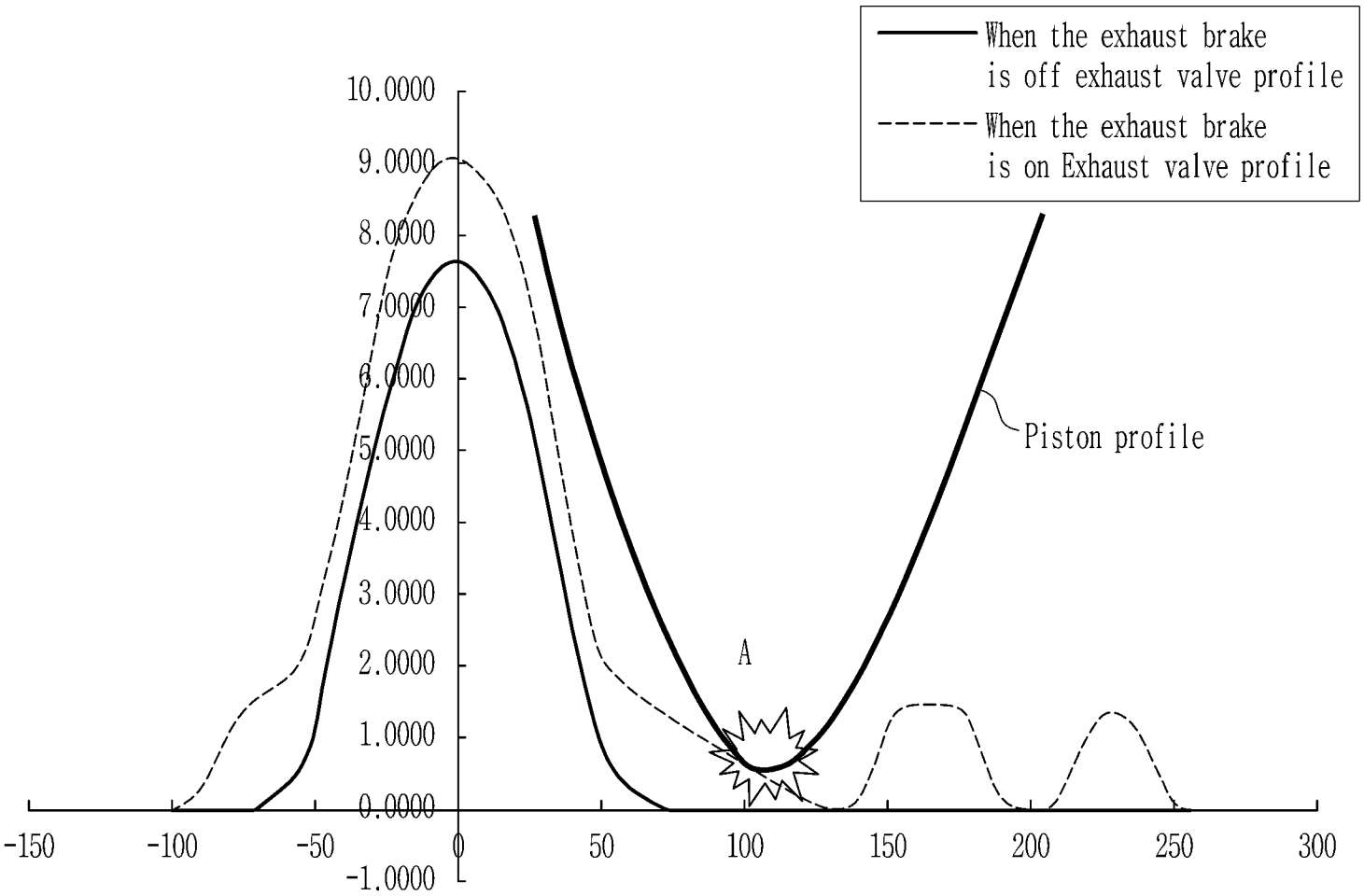
FIG. 13 is a graph showing the valve lift displacement when a general compression release type engine brake is used.
Figure 14:
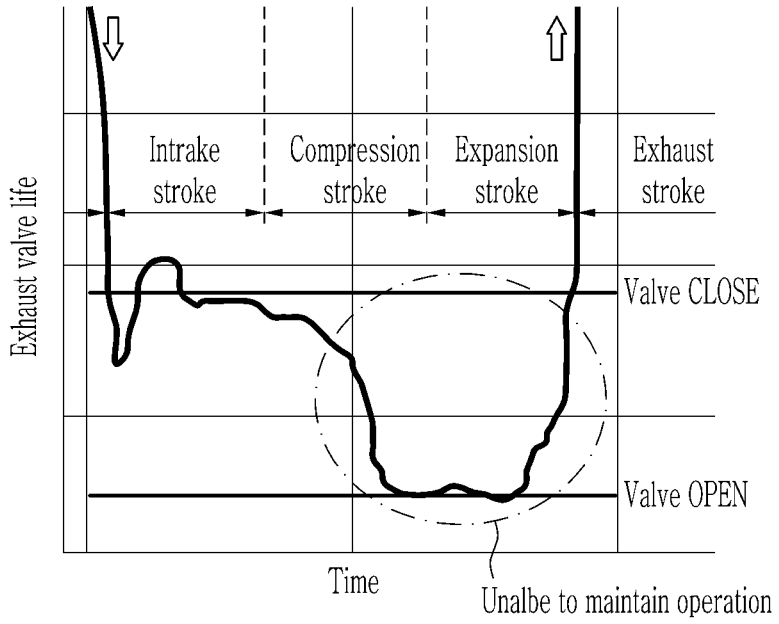
FIG. 14 is a graph showing the valve lift during operation of a general compression release type engine brake.

FIG. 12 is a graph comparing the operation of a general compression release type engine brake and a compression release type engine brake according to various exemplary embodiments of the present invention.

In exemplary embodiments of the present invention, as shown in FIG. 12, the required contact characteristic between the adjusting screw 28 and the brake module 50 may be easily adjusted by adjusting the number of coil turns of the shaft spring 90, and 91. Therefore, it is possible to suppress abnormal brake operation due to the occurrence of a gap between the adjusting screw 28 and the brake module 50 by adjusting the number of coil windings of the shaft springs 90 and 91 without major design changes such as the engine.

Furthermore, in exemplary embodiments of the present invention, the shaft spring 90, and 91 may secure robustness against the load in the axial direction of the rocker arm shaft 20, and through this, the gap between the first opening unit 17 and the second opening unit 19 may be kept constant.

Furthermore, the configuration of the reset member 80 is simple and the operation oil may be smoothly removed, suppressing the possibility of contact between the exhaust valve and the engine piston during brake operation and securing the operation reliability of the engine brake.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. An engine brake apparatus comprising:

a first opening unit and a second opening unit each including:

an exhaust rocker arm that rotates around a rocker arm shaft;

an adjusting screw provided at an end portion of the exhaust rocker arm;

a brake module configured to selectively receive oil from the adjusting screw, the brake module including a brake piston mount portion;

a brake piston movably provided in the brake piston mount portion such that a portion of the brake piston selectively protrudes out of the brake module when the oil is supplied to the brake module;

a reset member configured to selectively exhaust the oil from the brake module; and a valve bridge connected to the brake piston, the valve bridge including an exhaust valve; and a shaft spring mounted to the rocker arm shaft between the first opening unit and the second opening unit, the shaft spring configured to set a spacing between the first opening unit and the second opening unit, wherein the exhaust rocker arm of at least one of the first opening unit and the second opening unit includes a rocker arm protrusion, and wherein the shaft spring is further configured to press on the rocker arm protrusion so as to maintain the adjusting screw engaged with the brake module.

2. The engine brake apparatus of claim 1, wherein the shaft spring includes:

a coil portion wound around the rocker arm shaft; and an extension portion extending from the coil portion so as to press on the rocker arm protrusion.

3. The engine brake apparatus of claim 2, wherein a shaft fixing hole is formed in the rocker arm shaft, and wherein the shaft spring further includes a fixing portion inserted into the shaft fixing hole.

4. The engine brake apparatus of claim 2, wherein the first opening unit and the second opening unit each further include an intake rocker arm that rotates around the rocker arm shaft, and wherein the shaft spring is provided between the exhaust rocker arm of the first opening unit and the intake rocker arm of the second opening unit.

5. The engine brake apparatus of claim 4, wherein the intake rocker arm of the second opening unit includes an outwardly extending intake rocker arm protrusion, and wherein the shaft spring further includes a fixing portion fixed to the intake rocker arm protrusion.

6. The engine brake apparatus of claim 1, wherein the brake module further includes:

an upper portion defining an inlet configured to receive the oil from the adjusting screw; and a side portion defining a reset member mount portion configured to fluidically communicate with the brake piston mount portion.

7. The engine brake apparatus of claim 6, further comprising:

a push pin mounted to an upper portion of a cylinder head, wherein the reset member is arranged in the reset member mount portion and selectively contacts the push pin so as to exhaust the oil from the brake module.

8. The engine brake apparatus of claim 7, wherein the reset member mount portion includes:

a first passage fluidically connected to the brake piston mount portion via a first outlet; and a second passage connected to the first passage via a slanted surface, the second passage further connected to a second outlet of the reset member mount portion, wherein a diameter of the first passage is greater than a diameter of the second passage, and wherein the oil is exhausted from the brake module via the second outlet.

9. The engine brake apparatus of claim 8, wherein the reset member includes:

a reset valve movably provided in the reset member mount portion between the first outlet and the second outlet so as to selectively open the second outlet when the reset valve contacts the push pin; and a reset spring elastically biasing the reset valve toward a closed position.

10. The engine brake apparatus of claim 9, wherein the reset valve includes a circumferential passage groove formed on an upper external surface of the reset valve, and wherein an upper end portion of the reset valve is configured to selectively engage the slanted surface formed as a stop which maintains the reset valve in the reset member mounting portion.

11. The engine brake apparatus of claim 6, wherein the brake piston defines an accommodation space.

12. The engine brake apparatus of claim 11, wherein the brake module further includes a check valve and a check valve spring disposed in the accommodation space, the check valve spring configured to bias the check valve so as to close the inlet, and to open the inlet when the oil is received from the adjusting screw.

13. The engine brake apparatus of claim 6, wherein the brake module further includes a stopper configured to limit a movement of the brake piston.

14. The engine brake apparatus of claim 13, wherein the brake piston includes an upper protrusion and a lower protrusion protruding from an outer circumference of the brake piston.

15. The engine brake apparatus of claim 14, wherein an end portion of the stopper is positioned between the upper protrusion and the lower protrusion so as to limit the movement of the brake piston when the upper protrusion abuts the end portion of the stopper.

* * * * *